United States Patent [19]

Rohrs

[11] 4,092,991

[45] June 6, 1978

[54] CLEANING MACHINE

[75] Inventor: Marvin K. Rohrs, Fanwood, N.J.

[73] Assignee: Metalwash Machinery Corporation, Elizabeth, N.J.

[21] Appl. No.: 687,078

[22] Filed: Apr. 16, 1976

Related U.S. Application Data

[60] Division of Ser. No. 623,210, Oct. 16, 1975, abandoned, which is a continuation of Ser. No. 481,072, Jun. 20, 1974, abandoned, which is a continuation-in-part of Ser. No. 458,635, Apr. 8, 1974, abandoned.

[51] Int. Cl.[2] ..... B08B 9/08

[52] U.S. Cl. ..... 134/127; 134/131; 134/152; 134/170; 198/626; 198/836

[58] Field of Search ..... 134/68, 127, 131, 152, 134/170; 74/239, 243 R, 243 C; 198/165, 168, 193, 194, 198, 203

[56] References Cited

U.S. PATENT DOCUMENTS

| | | | |
|---|---|---|---|
| 241,796 | 5/1881 | Ewart | 198/168 |
| 1,055,843 | 3/1913 | Warren | 134/131 X |
| 1,561,503 | 11/1925 | Barry et al. | 134/131 X |
| 1,627,354 | 5/1927 | Thorsten | 198/193 |
| 2,371,747 | 3/1945 | Faris et al. | 198/194 |
| 2,660,513 | 11/1953 | Ball | 134/131 X |
| 3,291,143 | 12/1966 | Huddle | 134/68 |
| 3,310,161 | 3/1967 | Kraft, Jr. | 198/193 |

*Primary Examiner*—Robert L. Bleutge
*Attorney, Agent, or Firm*—Nolte and Nolte

[57] ABSTRACT

A cleaning or treating machine, particularly but not necessarily exclusively for cleaning newly formed aluminum beverage cans, has a belt for conveying items placed thereon through various stages of a washing cycle and a hold-down conveyor overlying the cans for preventing them from tipping. The hold-down conveyor has stiffening means extending thereacross and is trained over rolls or drums which are specially formed to accommodate the stiffening means. The conveyor is longitudinally supported by having rollers projecting from its longitudinal edges and which ride on tracks.

4 Claims, 4 Drawing Figures

CLEANING MACHINE

This application is a division of application Ser. No. 623,210 filed Oct. 16, 1975; which is a continuation of Ser. No. 481,072 filed June 20, 1974; and which is a continuation-in-part application of application Ser. No. 458,635 filed Apr. 8, 1974 all of which are now abandoned.

This invention is concerned with a machine for treating articles, particularly, but not necessarily exclusively it is concerned with a machine for cleaning articles such as newly formed beverage cans and other fragile articles.

A machine for this purpose and of the general kind with which this invention is concerned is disclosed in U.S. Pat. No. 3,442,708 issued May 6, 1967 to Harley E. Huddle. The apparatus of that patent comprises a lower perforate conveyor upon which the cans or other articles to be cleaned or otherwise treated are disposed to be transported through the various stages of the machine, such as cleaning, rinsing and drying stages. To preclude tipping of the containers on the lower conveyor and consequent damage to their fragile edges, there is provided an overlying holddown conveyor of mesh or other perforate and flexible material.

In the disclosure of the Huddle patent reference is made to the lower run of the upper conveyor being slightly spaced from the upper edges of the cans so that the cans are blown upwardly by sprays directed at their undersides into contact with that conveyor and, since the conveyor moves at a similar speed to the lower conveyor, are conveyed through the machine. The difficulty arises that the conveyor is usually woven and is flexible so that it adopts a catenary both in the longitudinal direction and in the transverse direction. Thus if the height of the conveyor is set so that the central portions thereof are spaced slightly above the tops of the cans the outer and end portions of the lower run of the conveyor are spaced so far from those cans that the cans can tip. On the other hand, if the outer and end portions of the conveyor are set slightly spaced from the upper edges of the cans then the central regions of the conveyor press down upon the cans with sufficient force to cause damage to their fragile rim portions.

While considerable significance is attached in the aforementioned patent to the slight spacing between the lower run of the upper conveyor and the tops of the can, little real significance can be attached to this since the major purpose of the upper conveyor is simply to prevent tipping and in the past this type of upper holddown conveyor has been utilized and the spacing between the lower run and the upper run of the lower conveyor has been adjustable and in many instances has been such as would cause the lower run of the upper conveyor to rest upon the tops of the cans, at least in certain regions, or has been such as would insure that the conveyor was spaced always from the tops of the cans.

The present invention seeks to avoid these disadvantages by providing a conveyor in which the tendency of the conveyor to sag or adopt a catenary shape in both the longitudinal and transverse directions is minimized to the point of being inconsequential. An embodiment of this invention is illustrated in the accompanying drawings, in which.

Figure 1:
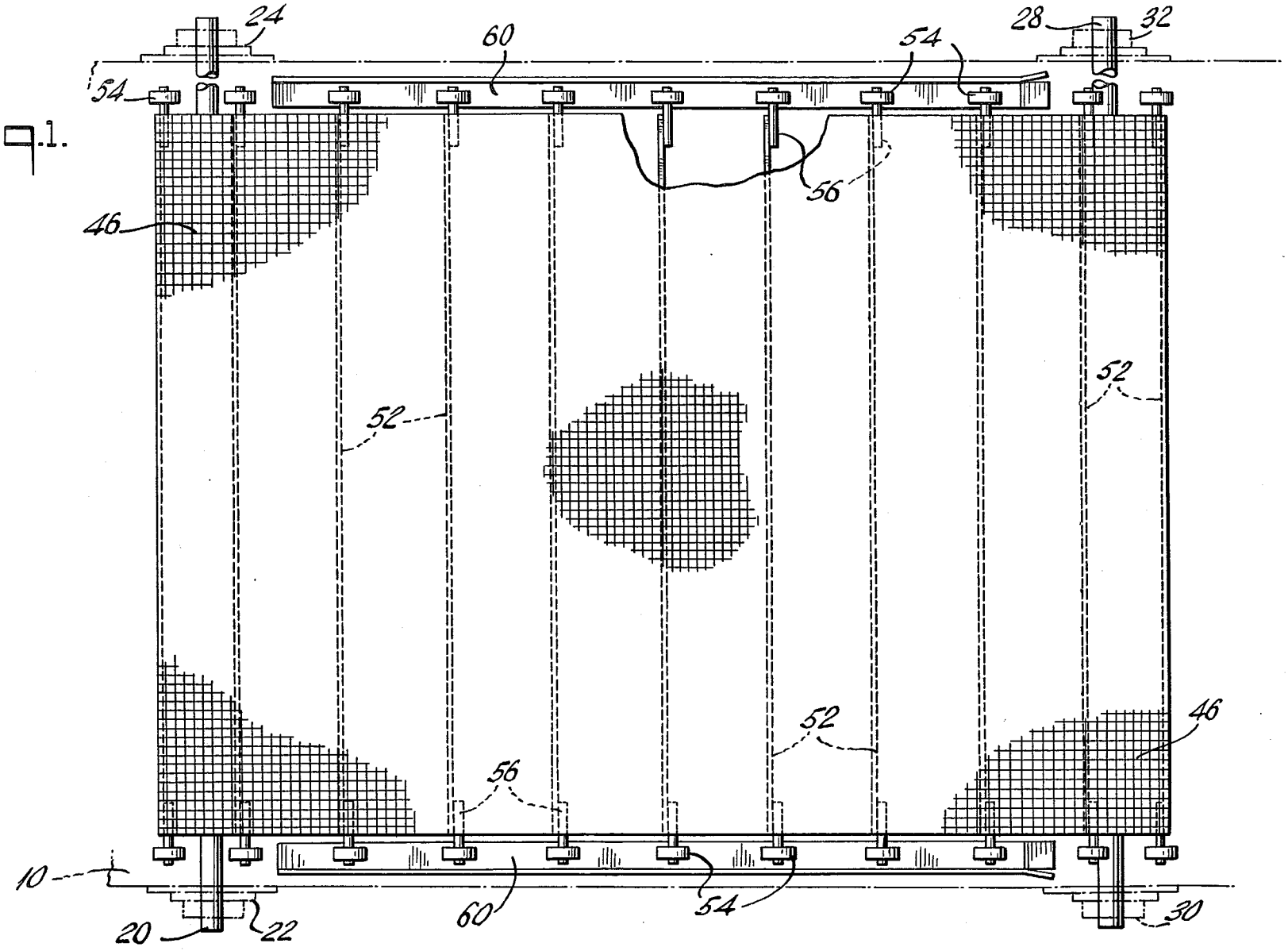
FIG. 1 is a plan view of part of a cleaning machine according to this invention, other parts having been omitted in the interests of clarity.

Referring to the drawings, the machine frame is indicated in chain dot line generally at 10 and is mounted upon longitudinally extending beams 12. The machine basically comprises a lower, can or other article supporting conveyor of which the upper run is indicated at 14 and above that conveyor a hold-down conveyor indicated generally at 16. It must be appreciated at this time that the remainder of the machine may be largely conventional comprising the usual sprays of various chemicals and cleaning materials for cleaning and rinsing or otherwise treating the cans or other articles. These items in themselves form no part of the present invention and are omitted from FIGS. 1 through 3 in the interests of clarity but are illustrated schematically in FIG. 4 and described with reference to that figure hereinafter.

The hold-down conveyor comprises a drive shaft 20 mounted in bearings 22 and 24 in opposite parts of the frame 10. One end of the drive shaft has a keyway 26 by which drive may be applied to it by any conventional means and the frame is slotted so that the height of the shaft may be adjusted relatively to the lower conveyor and secured in a selected position.

At the opposite end of the conveyor is an idler shaft 28 which is mounted in bearings 30 and 32 which also are mounted in vertical slots of the frame 10 to be adjustable for height.

Each of the shafts carries a plurality of spaced drum or wheel members 34 which together constitute the end drums of the conveyor.

Figure 2:
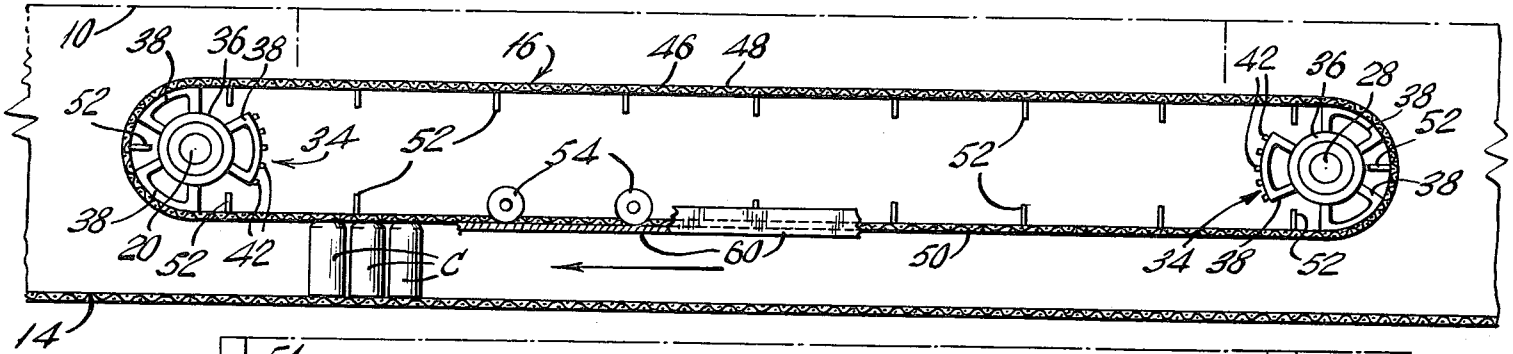
FIG. 2 is an end view of the machine of FIG. 1.

Each drum or wheel comprises a central hub 36 by which it is mounted on its corresponding shaft and projecting from the hub are three sector shaped portions 38 which as can be seen particularly in FIG. 2 are reinforced by fillets 40. The outer arcuate surfaces of the sector portions 38 are provided with pins 42 which serve a purpose described hereinafter. In the particular embodiment illustrated, the three sector shaped portions extend over an arc of about 60° and are separated by spaces which also cover an arc of about 60°, i.e., the sector portions are equiangularly distributed around the hub 36. It will be appreciated that the sector shaped portions may be of different sizes than those illustrated herein, for example, they may extend over an arc of 90° and be separated by spaces covering an arc of 30°.

An endless conveying belt 46 is formed of a wire weave or mesh of other convenient perforate and flexible material structure. The weave is such that the pins 42 may engage therewith to transmit drive to the belt.

Figure 3:
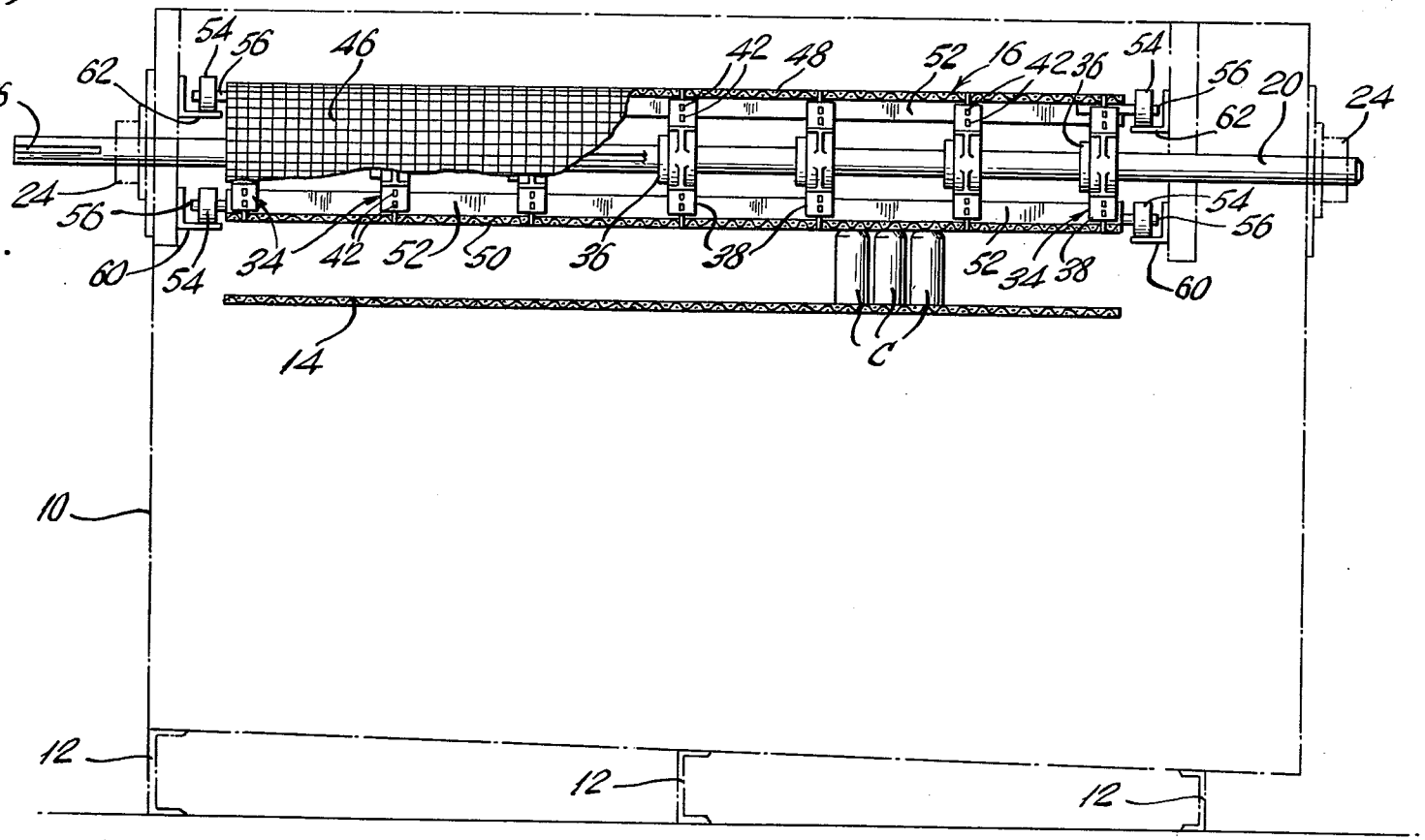
FIG. 3 is a side view of that machine.

The belt defines an upper course 48 and a lower course 50, the lower course 50 being adapted to prevent tipping of cans C shown in FIGS. 2 and 3.

Extending transversely on the inner surfaces of the conveyor belt, i.e. those surfaces contacting the drums, are stiffeners 52 of flat strip or bar and the edges of those bars are welded or otherwise secured to the material of the conveyor. It is to be appreciated that for securing the stiffeners to the material of the conveyor belt 46, the stiffeners may be of L-section so that the area of attachment of the stiffeners is increased. It is important however that the restriction which they present to the passage of spray liquid or other materials through the belt be limited.

The stiffeners are spaced along the length of the belt so as to lie in the spaces between the sector portions of the drums of the conveyor as the belt passes over the drums. In this particular case, this means that they are spaced apart by about ⅓ the circumference of the drums.

It will be appreciated that the stiffeners 52 will substantially preclude transverse sagging of the conveyor belt. To substantially preclude longitudinal sagging, rollers 54 are mounted upon spindles 56 which are secured by any convenient means to the ends of the stiffener members 52. On a frame member adjacent the longitudinal edges of the conveyor are formed tracks 60 and 62, the tracks being of L-section and the rollers ride on horizontal portions of those sections. The rollers 54 of a lower course of the conveyor are supported on tracks 60 and those of an upper course of the conveyor are supported on tracks 62. Tracks 60 have slots for vertical adjustment.

It is to be appreciated that the shafts 20 and 28 and tracks 60 are shiftable vertically to adjust the spacing between the lower course of conveyor 46 and the upper course of the transport conveyor. In this way, different heights of containers can be accommodated between the two belts.

The hold-down conveyor can be adjustable for height in the manner illustrated in U.S. Pat. No. 2,655,162 issued Oct. 13, 1953 to Zademach and Clark and assigned to the Metalwash Machinery Corporation. Alternatively, and as illustrated herein, the bearings supporting the shafts are mounted in slotted openings of a support member mounted on the frame so as to be shiftable within those slots and clamped in a desired position.

To accommodate the stiffeners in the drums of the conveyor the surfaces of those drums may be appropriately notched rather than those drums consisting of the sector portions particularly illustrated in the drawing.

Figure 4:
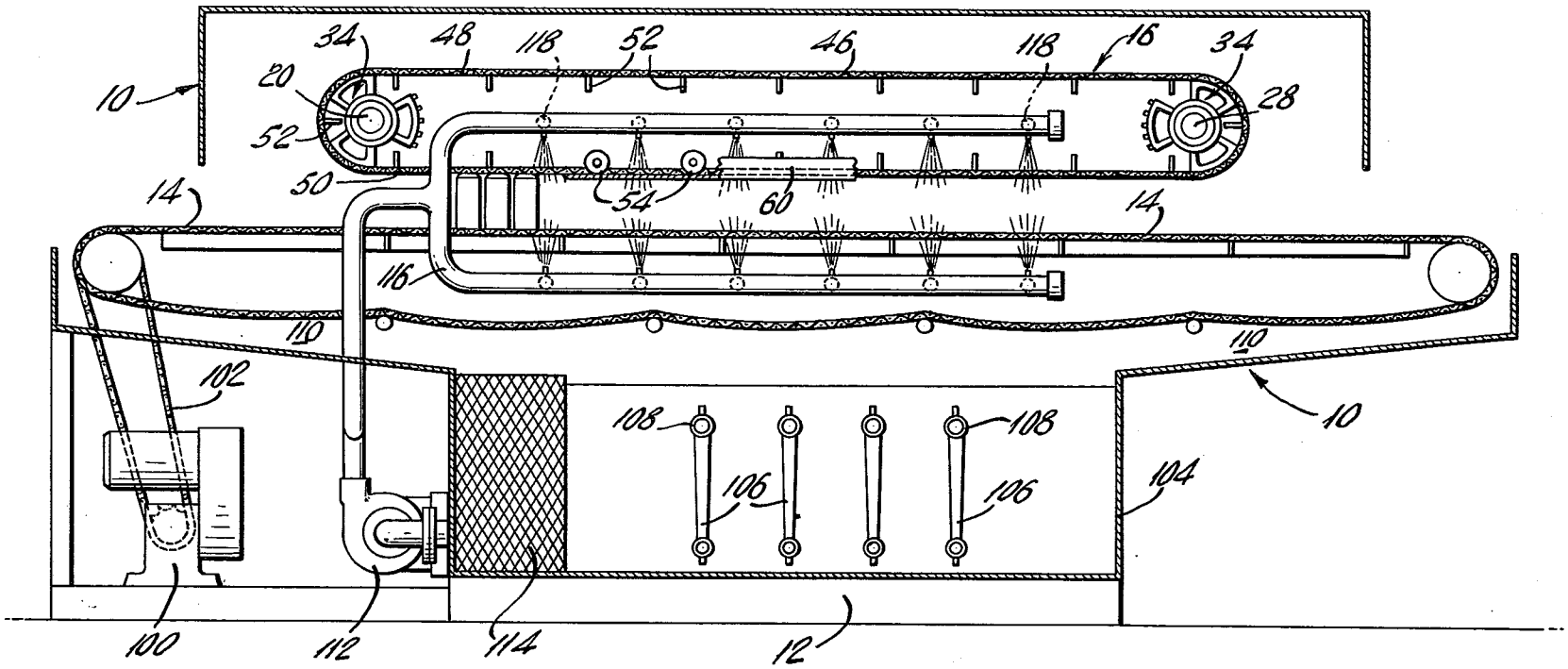
FIG. 4 is a side view, similar to FIG. 3 but showing parts of the machine omitted in FIGS. 1 through 3.

A machine to which this present invention is applied is illustrated schematically in FIG. 4 and in that figure and in FIGS. 1 through 3, like numerals identify like parts.

In the embodiment of FIG. 4 the transport conveyor 14 and the hold-down conveyor 16 are largely similar to those illustrated in FIGS. 1 through 3 and both are driven from a drive unit 100 through conventional belts or drive systems indicated generally at 102.

Extending beneath the transport conveyor 14 is a tank indicated generally at 104 and comprising a reservoir unit 106 provided with heating coils 108, and pan sections 110 which catch fluid falling from the conveyor and lead it to the reservoir.

A pump 112 which may be driven by drive unit 100 has its intake communicating with a screened region 114 of the reservoir and its outlet communicating with a manifold arrangement comprising branches pipes 116 which are disposed to one side of and extend longitudinally along the conveyors 14 and 16. The upper branch 116 has a plurality of pipes 118 which extend transversely of the conveyors and between the upper and lower courses of the hold-diown conveyor 16. The pipes 118 have at intervals along their lengths conventional jet orifices which are directed downwardly to pass fluid pumped by pump 112 through the lower course of the conveyor 16 and to impinge on the cans C.

Similarly, lower branch 116 has pipes 120 which extend transversely between the upper and lower courses of the transport conveyor 14, those pipes 120 being provided with upwardly directed jet orifices which direct liquid reaching those orifices from pump 112 through the upper course of conveyor 14 onto the cans C.

It is of course to be appreciated that various chemicals could be directed through the sprays to treat articles and that by simple and largely conventional modifications the articles could be exposed to multiple treatments with the apparatus of this invention.

What is claimed is:

1. A machine for washing beverage cans comprising a transport conveyor including a reticulate belt member upon an upper course of which cans to be washed are carried and a hold-down conveyor including a reticulate belt member having a lower course space above the upper course of said transport conveyor, spray means disposed to direct liquid through said belt members and onto said cans, said belt member of said hold-down conveyor being trained around conveyor drums, a surface of the hold-down belt member contacting said drums having a plurality of longitudinally spaced and transversely extending stiffener members projecting therefrom and said conveyor drums having recesses on belt member contacting surfaces thereof, said recesses being circumferentially spaced around said surface whereby said stiffener members, during the passage of the hold-down conveyor belt around said drums, extend into said recesses and opposite surfaces of said belt member of said hold-down conveyor being adapted for engagement with said cans and being substantially free of projections, said stiffener members each consisting only of a single flat strip disposed substantially normal to adjacent portions of said belt member of said hold-down conveyor and each being secured thereto at an edge region of said strip to leave the regions of the belt member between the planes of said strips substantially free of restriction to the passage of said sprays therethrough, said belt member being provided with a plurality of roller means projecting laterally from the edges thereof, said roller means cooperating with track means disposed adjacent longitudinal edges of the lower course of said hold-down conveyor to guide said lower course and prevent sagging of said longitudinal edge regions of said belt member.

2. Apparatus as claimed in claim 1 wherein track means are provided adjacent longitudinal edges of the upper course of such hold-down conveyor belt means.

3. Apparatus as claimed in claim 1 wherein said conveyor drums comprise a plurality of sector sahped portions, arcuate circumferential portions of which contact said surface of said belt, adjacent sector shaped portions defining said recesses there between.

4. Apparatus as claimed in claim 1 wherein said roller means are secured to end regions of said stiffener members.

* * * * *